United States Patent [19]

Broadhurst et al.

[11] 4,146,461

[45] Mar. 27, 1979

[54] DILUTION CHILLING DEWAXING BY MODIFICATION OF TOWER TEMPERATURE PROFILE

[75] Inventors: Thomas E. Broadhurst; James D. Eagan, both of Sarnia, Canada; Stephen F. Perry, Westfield, N.J.

[73] Assignee: Exxon Research & Engineering Co., Florham Park, N.J.

[21] Appl. No.: 864,213

[22] Filed: Dec. 27, 1977

Related U.S. Application Data

[63] Continuation-in-part of Ser. No. 736,066, Oct. 27, 1976, abandoned.

[51] Int. Cl.[2] ..... C10G 43/08

[52] U.S. Cl. ..... 208/33; 208/38

[58] Field of Search ..... 208/33, 37, 38

[56] References Cited

U.S. PATENT DOCUMENTS

| | | | |
|---|---|---|---|
| 3,642,609 | 2/1972 | Mayer et al. | 208/33 |
| 3,644,195 | 2/1972 | Gudelis et al. | 208/33 |

*Primary Examiner*—Herbert Levine

*Attorney, Agent, or Firm*—Edward M. Corcoran

[57] ABSTRACT

An improved DILCHILL* dewaxing process wherein waxy lubricating oil stocks are solvent dewaxed by contacting them with successive increments of cold dewaxing solvent at a plurality of points along the height of a vertical tower divided into a plurality of stages while agitating the oilsolvent mixture in each stage to provide substantially instantaneous mixing of the waxy oil and solvent thereby precipitating wax from the oil while avoiding the well known shock chilling effect. The improvement resides in adjusting the cold solvent addition to each stage in a manner so as to modify the temperature profile along the tower to ensure that the temperature drop per stage in the initial stages in which wax precipitation occurs is greater than the temperature drop per stage in the final or later stages in which wax precipitation occurs.

* DILCHILL is a registered Service Mark of Exxon Research and Engineering Company.

7 Claims, 3 Drawing Figures

DILCHILL SOLVENT DISTRIBUTION FOR OPTIMUM FILTER RATE

DILUTION CHILLING DEWAXING BY MODIFICATION OF TOWER TEMPERATURE PROFILE

CROSS REFERENCE TO RELATED APPLICATIONS

This is a continuation-in-part of copending U.S. Ser. No. 736,066, filed Oct. 27, 1976 now abandoned.

BACKGROUND OF THE INVENTION

1. Field of the Invention

This invention relates to a process for solvent dewaxing waxy hydrocarbon oils. More particularly, this invention relates to an improved process for dilution chilling dewaxing waxy petroleum oil stocks in a staged chilling zone wherein cold dewaxing solvent is injected into said zone at a plurality of stages therealong and wherein the cold dewaxing solvent and the waxy oil are substantially instantaneously mixed in each stage as the waxy oil-solvent mixture passes from stage to stage, the improvement comprising modifying the temperature profile along said zone by adjusting the cold solvent distribution to each stage so that the temperature drop is greatest in the first stage into which cold solvent is injected with the stage to stage temperature drop progressively decreasing as the waxy oil-solvent mixture progresses through said chilling zone. This invention is particularly useful for dewaxing waxy lubricating oil stocks.

2. Description of the Prior Art

It is well known that wax-containing petroleum oil stocks can be dewaxed by shock chilling with a cold solvent. It is also known that shock chilling, in itself, results in a low filtration rate of the dewaxed oil from the resultant wax/oil-solvent slurry. It is now well known that the harmful effects of shock chilling can be overcome by introducing the waxy oil into a staged chilling zone and passing the waxy oil from stage to stage of the zone, while at the same time injecting cold dewaxing solvent into a plurality of the stages and wherein a high degree of agitation is maintained in the stages so as to effect substantially instantaneous mixing of the waxy oil and solvent. As the waxy oil passes from stage to stage of the cooling zone it is cooled to a temperature sufficiently low to precipitate wax therefrom without incurring the harmful effects of shock chilling. This technique produces a wax/oil-solvent slurry wherein the wax particles have a unique crystal structure which provides superior filtering characteristics such as high filter rates and high dewaxed oil yields. The basic concept of dilution chilling dewaxing is disclosed in U.S. Pat. No. 3,773,650, the disclosures of which are incorporated herein by reference and will hereinafter be referred to as DILCHILL for the sake of brevity.

A number of improvements and modifications have been made to the basic concept of DILCHILL. U.S. Pat. No. 3,642,609 shows that in a vertically staged cooling tower, the velocity of the solvent at the injection points within each stage should be at least 5–30 times that of the peripheral velocity of the mixer blades. This results in greater filtration rates and higher dewaxed oil yields than could otherwise be obtained without the relatively high velocity solvent injection. In U.S. Pat. No. 3,775,288 is disclosed a combination of dilution chilling with scraped surface chilling for dewaxing lubricating oils. U.S. Pat. No. 3,681,230 discloses adjusting the dewaxing solvent composition so that the waxy oil and solvent are immiscible near the last stage of the cooling zone. This results in superior dewaxed oil yields and higher filter rates when the waxy oil stock being fed to the tower is relatively high in viscosity and molecular weight. U.S. Pat. No. 3,850,740 discloses partially prediluting the waxy oil when same is a relatively heavy feed such as a resid or a bright stock, before the oil is introduced into the chilling zone.

However, in all of these DILCHILL dewaxing processes it was thought that the rate of solvent addition to each stage should be adjusted so as to obtain the same or approximately equal temperature drops in each stage. For example, U.S. Pat. No. 3,773,650 in column 6, lines 7–11, discloses adding cold solvent so as to give equivalent temperature drops per stage. Similarly, in U.S. Pat. No. 3,775,288 at column 4, lines 38–43, it is disclosed that the same temperature drop should be maintained from stage to stage of the chilling zone. Further, all of the DILCHILL dewaxing processes in commercial use up to the present time have been designed for and operated with equal temperature drops per stage. It was thought that this was the optimum temperature profile and method of solvent distribution, since it is well known to those skilled in the art that the shock chilling inherent in a large, sudden temperature drop, particularly in the early stages of wax precipitation, tends to cause excessive nucleation, the production of many fine crystals, and hence, poor filtration and relatively high liquid to solids ratios in the wax cake. Therefore, it was relatively unexpected to discover that modifying the temperature profile in a DILCHILL dilution chilling zone so as to provide the greatest stage to stage temperature drop in the early stages in which wax precipitation occurs would result in an improvement in the process as measured by higher dewaxed oil filter rates and lower liquid to solids ratios in the wax cake.

SUMMARY OF THE INVENTION

It has now been discovered that DILCHILL dewaxing processes can be improved by modifying the temperature profile of the chilling zone so that the greatest temperature drop occurs in the first stages therein in which wax precipitation occurs as opposed to the heretofore regarded optimization of said processes via approximately equal temperature drop per stage. That is, in a process for dewaxing a waxy petroleum oil stock comprising introducing said waxy oil stock into an elongated chilling zone divided into a plurality of stages and passing said waxy oil from stage to stage of said zone while injecting cold dewaxing solvent into at least a portion of said stages and maintaining a high degree of agitation in a plurality of the solvent-containing stages so as to achieve substantially instantaneous mixing of said waxy oil and said solvent thereby cooling said solvent-waxy oil mixture as it progresses from stage to stage through said chilling zone and thereby precipitating at least a portion of said wax from said oil under conditions of said high degree of agitation, separating the precipitated wax from the solvent-oil mixture and recovering a petroleum oil stock of reduced wax content from said mixture, the improvement which comprises adjusting the rate of solvent addition to each solvent-containing stage so that the greatest temperature drop occurs in the first stage of the chilling zone into which cold dewaxing solvent is injected and in which wax precipitation occurs, with the subsequent stage to stage temperature drops in the remaining stages into which cold dewaxing solvent is injected and in which wax precipitation occurs progressively decreasing as the waxy oil-solvent mixture progresses through said chilling zone.

Further, it has been discovered that the chilling profiles representing the optimum combinations of high wax filtration rates and wax cake dryness may be characterized by the ratio of the temperature drop which occurs between the temperature of the oil feed entering the first wax crystallization (solvent injection) stage and the temperature to which the oil is chilled in said first stage, to the temperature drop which occurs between the next to the last and the last stage in which wax crystallization occurs. Alternatively, the ratio of the temperature drop across the first 10% of the solvent-containing/wax crystallization stages (starting with the feed temperature) to the temperature drop across the last 10% of the solvent-containing/wax crystallization stages may be used. Optimum results are obtained when this ratio numerically ranges from 2 to 20, in contrast to a ratio of 1, which represents an equal temperature drop per stage and which temperature profile was previously thought to represent the optimum operating conditions.

Any waxy petroleum oil stock or distillate fraction thereof may be dewaxed with the process of this invention. In general, these oil stocks or distillate fractions will have a boiling range within the broad range of from about 500° F. to about 1300° F. Preferred oil stocks are the lubricating oil and specialty oil fractions boiling within the range of 550° F. and 1200° F. However, residual waxy oil stocks and bright stocks having an initial boiling point above about 800° F. and containing at least about 10 wt.% of material boiling above about 1050° F. may also be dewaxed by the process of the instant invention. These fractions may come from any source, such as the paraffinic crudes obtained from Aramco, Kuwait, the Panhandle, North Louisiana, naphthenic crudes such as Coastal crudes, Tia Juana, etc., as well as the relatively heavy feedstocks such as the bright stocks having a boiling range of 1050° F.+ and synthetic feedstocks derived from Athabasca tar sands, etc.

Any solvent useful for dewaxing waxy petroleum oils may be used in the process of this invention. Representative examples of such solvents are (a) the aliphatic ketones having from 3–6 carbon atoms, such as acetone, methylethyl ketone (MEK) and the methyl isobutyl ketone (MIBK) and (b) the low molecular weight autorefrigerant hydrocarbons, such as ethane, propane, butane and propylene, as well as mixtures of the foregoing and mixtures of the aforesaid ketones and/or hydrocarbons with aromatic compounds, such as benzene, xylene and toluene. In addition, halogenated, low molecular weight hydrocarbons, such as $C_2$-$C_4$ chlorinated hydrocarbons (e.g., dichloromethane, dichloroethane, methylene chloride) and mixtures thereof may be used as solvents. Specific examples of suitable solvent mixtures are methylethyl ketone and methyl isobutyl ketone, methylethyl ketone and toluene, dichloromethane and dichloroethane, propylene and acetone. Preferred solvents are ketones.

DETAILED DESCRIPTION

Figure 1:
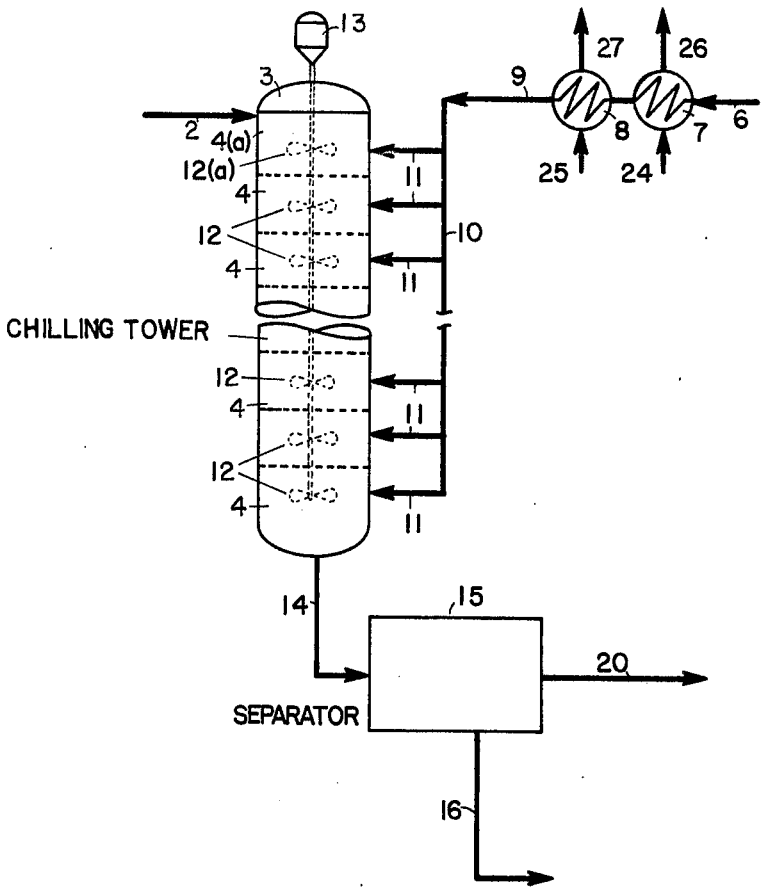
FIG. 1 is a flow diagram of a DILCHILL dewaxing process employing the embodiment of the instant invention.

Referring to FIG. 1, the oil stock to be dewaxed, at a temperature slightly above its cloud point, is passed into the top of vertical DILCHILL chilling tower 3 via line 2 wherein it enters the first stage of the chiller 4(*a*). The solvent selected for dewaxing the oil stock is passed through heat exchangers 7 and 8 via line 6 wherein the solvent temperature is reduced to a level sufficient to cool the oil to the desired dewaxing temperature. Coolant enters heat exchangers 7 and 8 through lines 24 and 25, respectively, and leaves through lines 26 and 27. Cold solvent leaves heat exchanger 8 via line 9 and enters manifold 10. The manifold comprises a series of parallel lines providing solvent inlets 11 to the plurality of stages 4 of chilling tower 3. The rate of flow through each inlet is regulated by flow control means (not shown). The rate of solvent flow is regulated so as to maintain the desired temperature profile distribution from stage to stage along the height of chilling tower 3.

Figure 2:
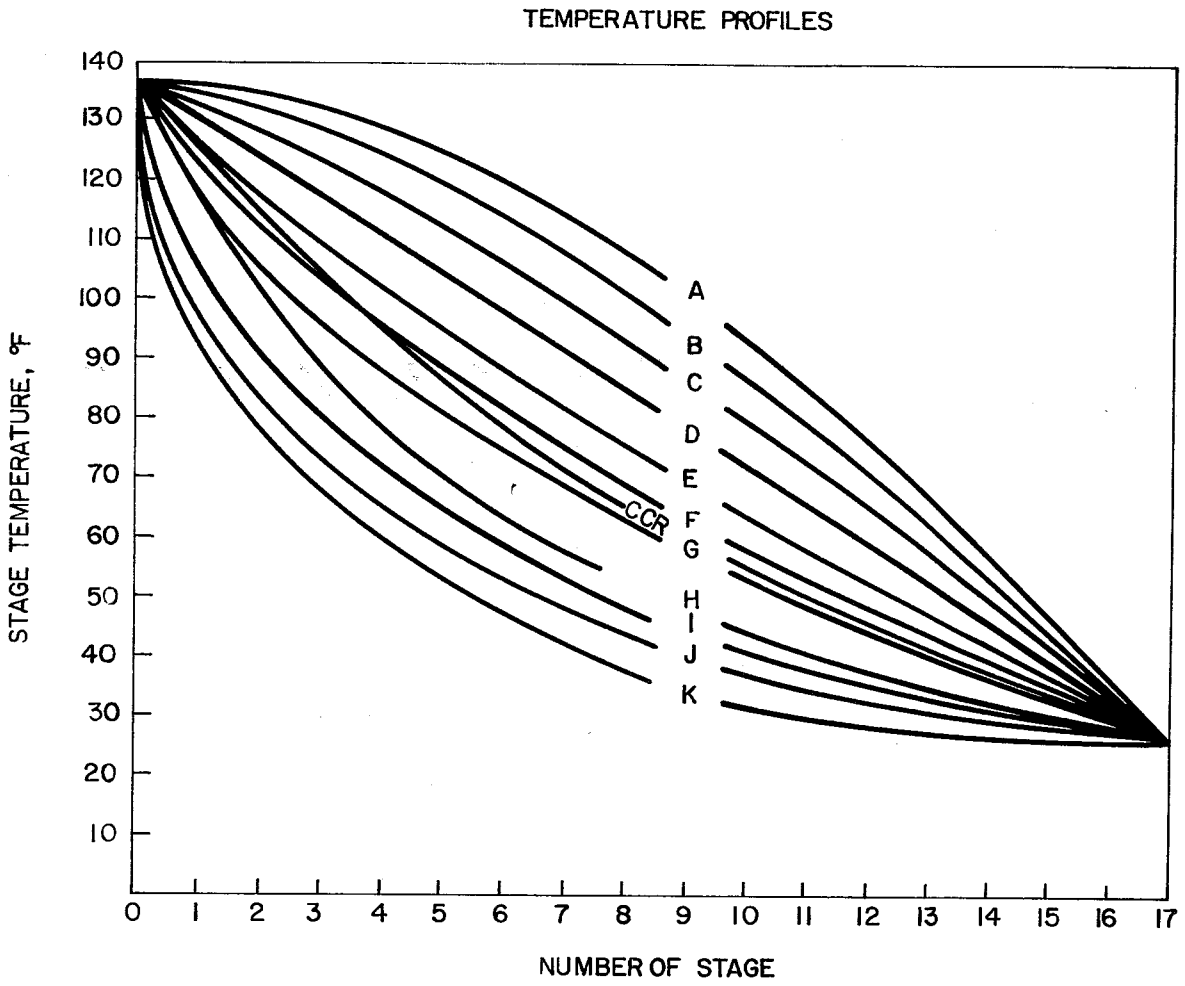
FIG. 2 is a graph showing various temperature profiles evaluated for a vertical, 17-stage DILCHILL dewaxing tower.

Although any of the temperature profiles illustrated in FIG. 2 will result in successfully dewaxing the waxy oil, temperature profiles encompassed within the embodiment of the instant invention are profiles E through I in FIG. 2. It is to be understood that wax precipitation and crystallization occur in all of the cold solvent-containing stages falling within the purview of the curves illustrated in FIG. 2. In order to achieve these temperature profiles within the instant invention, it is necessary to regulate the rate of flow of cold dewaxing solvent entering each stage so as to insure that the temperature drop in the first or initial stage in which wax precipitation occurs is greatest, with the temperature drop from wax precipitation stage to wax precipitation stage progressively decreasing as the waxy oil-solvent mixture progresses down the tower. This is illustrated by temperature profiles E through K in FIG. 2, although only temperature profiles E through I fall within the embodiment of this invention. Equal temperature drops from stage to stage are illustrated by temperature profile D in FIG. 2, while profiles A through C illustrate the case where the smallest temperature drops occur in the first or early stages of the tower. In general, the amount of solvent added thereto will be sufficient to provide a liquid/solid weight ratio between about 5/1 and 100/1 at the dewaxing temperature and a solvent/oil volume ratio between about 1.0/1 and 7/1. The overall average chilling rate of the oil is below about 10° F. per minute and most preferably between about 1° and 5° F. per minute. By overall average chilling rate is meant taking the temperature drop in each stage divided by the residence time of the oil plus solvent in each stage to obtain the chilling rate for each stage, adding the individual stage chilling rates and dividing the sum thereof by the number of stages.

The first portion or increment of cold dewaxing solvent enters the first stage, 4(*a*), of chilling tower 3 wherein it is substantially instantaneously mixed with the oil due to the action of agitator 12(*a*). The agitator is driven by a variable speed motor 13 and the degree of agitation is controlled by a variation of the motor speed with due allowance for the flow rate through the cooling tower. Although only downward flow rate of the oil-solvent mixture through chilling tower 3 has been shown, this mixture may also pass upwardly through the tower, in which case the first and last stages will occur near the bottom and top of the tower, respectively. Additional prechilled solvent is introduced into at least a portion of the plurality of stages 4, through inlets 11, so as to achieve the desired temperature profile in the tower and at the same time to provide the desired degree of dilution. It should be noted that any number of stages, for example 50, may be employed; however, it is desirable that at least six stages be used. For most applications the number of stages will range between 10 and 20.

The oil-solvent mixture with precipitated wax passes from the final stage of the chilling tower through line 14 to means for separating the wax from said solution 15. Any suitable means, for such separation may be employed, such as filtration or centrifugation. In general, filtration is a preferred means of separation. The oil-solvent mixture leaves wax separation means 15 via line 20 and is sent to further processing such as solvent recovery to recover the solvent therefrom. The wax leaves separation zone 15 via line 16 and then passes through additional refining and solvent recovery operations.

An essential feature of this invention is the maintenance of a high degree of agitation in all stages into which cold dewaxing solvent is injected and in which wax precipitation occurs. In general, the degree of agitation must be sufficient to provide substantially instantaneous mixing, i.e., substantially complete mixing of the oil-solvent mixture in one second or less. In this way, the deleterious effects of shock chilling are avoided and increased filtration rates are obtained. The degree of agitation required in this invention can be achieved by increasing the agitator RPM when all other mixing variables; e.g., flow rate through the mixer, vessel and agitator design, viscosity of the ingredients, etc., are maintained constant. In general, the degree of agitation required in this invention can be achieved when the modified Reynolds Number (Perry, "Chemical Engineer's Handbook," 3rd, p. 1224, McGraw-Hill, New York, 1959), $N_Re$, which is defined by the equation:

$$N_{Re} = L^2 nl/\mu$$

where

L = agitator diameter, feet
l = liquid density, pound/feet$^3$
n = agitator speed, revolution/second
$\mu$ = liquid viscosity, pound/feet second ranges between about 200 and about 150,000. The dimensionless ratio of chilling tower diameter to agitator diameter is between about 1.5/1 and about 10/1 and the ratio of the impeller blade length to impeller blade width ranges from about 0.75 to 2 and preferably from about 1 to 1.5. The ratio of the mixing stage height to the diameter of the stage will generally range from about 0.2/1 to about 1/1. A turbine type agitator is preferred, however, other types of agitators such as propellers may be used.

The chilling tower may or may not be baffled, but a baffled tower is preferred. Each stage will generally contain from about 2–8 baffles and preferably from 2–4 baffles located about the outer periphery of each stage. The width of the baffles may range from about 5–15% of the diameter of the tower. In general, the dimensionless ratio of the cross-section of the restricted flow opening between stages to the cross-section of the tower will be between about 1/10 and about 1/200.

In general, the chilling tower of the present invention will be operated at a pressure sufficient to prevent flashing of the solvent. Atmospheric pressure is sufficient when the ketones are employed as solvents; however, superatmospheric pressures are required when low molecular weight, autorefrigerant hydrocarbons, such as propane, are used. In some cases it is more advantageous to operate the tower under elevated pressure, even when the dewaxing solvent does not contain an autorefrigerant, in order to provide flow of the waxy oil-solvent slurry to an elevated location and/or wax filters, etc., without having to pump the slurry.

PREFERRED EMBODIMENT

The invention will be more apparent from the working examples set forth below.

EXAMPLE 1

In this example, experiments were run utilizing a single stage DILCHILL dewaxing laboratory batch unit which, while not completely duplicating continuous multistage operation, has been found to give results approximately equivalent to those obtained with continuous, commercial multistage operations. The batch unit contained a flat bladed impeller and a solvent injection tube. Experiments were conducted by filling the unit with the waxy oil to be chilled at just above its cloud point. After the unit was filled with the waxy oil, the impeller was started along with simultaneous injection of chilled solvent into the waxy oil at the impeller tip. The rate of solvent injection was varied as the run progressed to simulate conditions in successive stages of a 17 stage continuously operated tower. Excess slurry in the unit was allowed to overflow and be discarded. Following the addition of the desired volume of cold dewaxing solvent, the slurry from the unit was then scraped surface chilled at a rate of about 2°–3° F. per minute until the desired filter temperature was reached. The filter rate and the waxy oil yield as well as the wax cake liquids-solids ratio were determined by filtration and weighing the products.

The dewaxing solvent used in these experiments was a 45/55 parts by volume mixture of MEK and MIBK precooled to −20° F. The waxy oil feed was a phenol raffinate of a vacuum distillate cut from a Western Canadian crude (paraffinic), having a cloud point of about 129° F., a dry weight wax content of about 20%, a viscosity of 60 SUS at 210° F., and a V.I. of about 92. The experiments were conducted by varying the rate of cold dewaxing solvent injection to obtain the temperature profiles in FIG. 2. Inherent in FIG. 2 is the fact that cold dewaxing solvent is injected into, and wax precipitation and crystallization occur, in all 17 stages. The total amount of cold solvent dilution in this series of experiments was 3.2 volumes per volume of feed. The feed filter rate and liquids to solids ratio of the wax cake obtained are shown in Table 1.

These data show that, compared to profile D (conventional DILCHILL), temperature profiles E through I of FIG. 2 resulted in a substantial improvement in crystal formation, as measured by an increase in filter rate and a decrease in the liquids to solids ratio (wetness) of the wax cake. A lower liquids to solids ratio is indicative of a more complete separation of oil from wax due to better formed wax crystals.

Characterizations of the various temperature profiles shown in FIG. 2 were plotted against feed filter rate in order to determine the optimum region. The characterization was defined as the ΔT ratio calculated by either of the following methods:

$$\Delta T \text{ ratio} = \frac{\text{temperature of incoming feed minus temperature reached in first stage}}{\text{temperature reached in next-to-last stage minus temperature reached in last stage}}$$

$$\Delta T' \text{ ratio} = \frac{\text{temperature drop across first 10\% of the stages (starting with feed temperature)}}{\text{temperature drop across last 10\% of stages}}$$

Figure 3:
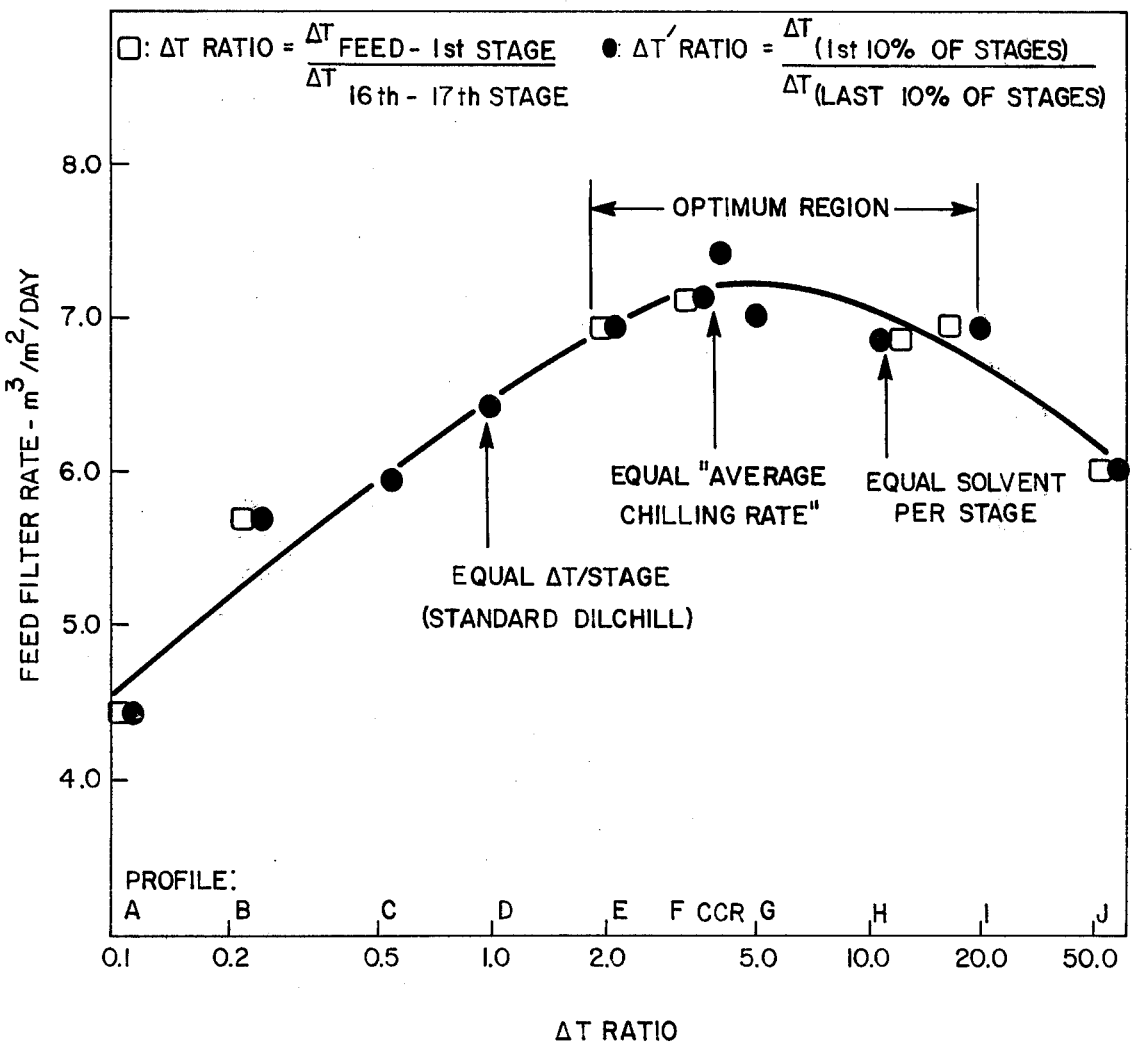
FIG. 3 is a graph illustrating the optimum region of temperature distribution within a DILCHILL dewaxing tower as measured by feed filter rate.

In both of the above, it is understood that stage refers to an agitated stage into which cold dewaxing solvent is injected and in which wax precipitation occurs. The ΔT and ΔT' ratios were plotted as a function of feed filter rate and are illustrated in FIG. 3. The data in FIG. 3 show that the optimum region occurs with a ΔT or ΔT' ratio ranging between 2 and 20.

EXAMPLE 2

This example was run with a continuous pilot plant DILCHILL dewaxing tower using the same feed in Example 1. Tower outlet slurry samples taken periodically were evaluated by filtration after scraped surface chilling at 2°-3° F. per minute to the filtering temperature. Experiments were conducted to provide the tower temperature profiles in FIG. 2 corresponding to (1) profile D which is the conventional DILCHILL temperature profile with equal temperature drops per stage, (2) the CCR or "constant stage chilling rate" temperature profile and (3) profile H which represents equal solvent injection rate per stage. The CCR or constant stage chilling rate is defined as meaning that the difference in temperature of the oil entering a stage and leaving that stage divided by the residence time of the oil plus solvent in that stage is the same for every stage in the tower in which wax precipitation occurs. The data for these experiments are shown in Table 2 and confirm the findings obtained with the laboratory batch unit to the effect that the use of the instant invention results in higher filter rates and also more complete separation of oil and wax as evidenced by lower liquid to solid ratios of the cake.

Turning to FIG. 2 in more detail, the curves plotted therein represent temperature profiles along a DILCHILL chilling tower as a function of stage temperature vs. the number of the stage, starting with zero being the inlet to the first or top stage of the tower and 17 the outlet of the 17th stage in a 17-stage tower. In all cases, cold dewaxing solvent is injected into and wax precipitation and crystallization occurs in each stage. The chilling rate in each stage is the temperature drop in that stage divided by the residence time of the oil (plus solvent) in that stage. In the first stage the cold dewaxing solvent contacts the relatively warm, waxy oil. In the second stage the cold dewaxing solvent contacts the oil/solvent/wax slurry produced in the first stage and so on. Therefore, the flow rate of total material through each stage increases, progressing from stage to stage down the tower, while the temperature differential between the cold dewaxing solvent and wax/oil/solvent slurry continuously decreases. Because the flow rate of the total material through each stage increases as the slurry progresses from stage to stage down the tower, the stage residence time of the material, defined as the stage volume divided by the flow rate of solvent, oil and wax, continuously decreases down the tower. Thus, for the equal temperature drop per stage mode of operation, which has heretofore been used and known in the art and practiced commercially as the DILCHILL process, the actual stagewise chilling rate increases progressively from stage to stage, because the stages are of substantially equal volume, but the residence time is continuously decreasing since the flow volume is continuously increasing through each stage. Thus, to obtain equal temperature drops per stage, the cold solvent injection rate has to be increased progressively in each stage because (a) the temperature difference between the cold solvent and the stage contents is decreasing and (b) the flow rate of material to be cooled is increasing. Typically, the cold solvent rate to the last stage may be as much as ten times that to the first stage. Therefore, in order to obtain the CCR (constant stage chilling rate) line in FIG. 2 which has hereinbefore been defined in Example 2, cold solvent is added to each stage at a rate such that the continual decreases in residence time progressing from stage to stage corresponds to a proportional decrease in temperature drop from stage to stage, so that the ratio of temperature drop divided by residence time remains constant for each stage. This explains why the CCR curve is not a straight line since the temperature drop per stage decreases from stage to stage. Curve H is not a straight line even though it represents equal solvent injection rates to all stages, because equal amounts of solvent must chill ever increasing amounts of solvent and waxy oil, which results in decreasing temperature drops in each of the successive stages.

TABLE 1

SINGLE STAGE DATA SHOWING THE EFFECT OF VARIOUS TEMPERATURE PROFILES ON FEED FILTER RATE AND LIQUIDS/SOLIDS

| Temperature Profile | Feed Filter Rate, cubic meters per square meter of filter surface per day | Liquids/solids ratio of wax cake |
|---|---|---|
| A | 4.43 | 4.50 |
| B | 5.70 | 3.60 |
| C | 5.94 | 3.76 |
| D (Standard dilution chilling) | 6.41 | 4.05 |
| E | 6.94 | 3.58 |
| F | 7.11 | 3.67 |
| CCR (Constant stage chilling rate) | 7.41 | 3.49 |
| G | 6.99 | 4.00 |
| H (Equal solvent injection rate) | 6.86 | 3.74 |
| I | 6.96 | 3.75 |
| J | 6.04 | 4.04 |
| K | 6.15 | 4.14 |

TABLE 2

DILUTION CHILLING IN CONTINUOUS PILOT PLANT - EFFECT OF TEMPERATURE PROFILE

Feed - Phenol Extracted Western Canadian Distillate
60 SSU/210° F.
92 V.I.
20 wt.% Wax Content
129° F. Cloud Point (134° F. inlet temperature)

Solvent - 45/55 MEK/MIBK
3.2/1 Total Dilution
−20° F. Inlet Temperature

Dilution Chilling Stages - 24
Filtering Temperature - +20° F.

| Temperature Profile | Feed Filter Rate $m^3/m^2/day$(1) | Liquids/solids ratio of wax cake |
|---|---|---|
| Equal ΔT/Stage(2) | 4.26 | 3.86 |
| Constant Stage Chilling Rate(3) | 4.89 | 3.55 |

TABLE 2-continued

| | | |
|---|---|---|
| Equal Solvent Injection Rate[4] | 5.31 | 3.65 |

[1]Cubic meters per square meter of filter surface per day.
[2]Temperature profile D in FIG. 2.
[3]Temperature profile CCR in FIG. 2.
[4]Temperature profile H in FIG. 2.

What is claimed is:

1. In a process for dewaxing a waxy petroleum oil stock comprising introducing said waxy oil stock into an elongated chilling zone divided into a plurality of stages and passing said waxy oil from stage to stage of said zone while injecting cold dewaxing solvent into at least a portion of said stages and maintaining a high degree of agitation in a plurality of the solvent-containing stages so as to achieve substantially instantaneous mixing of said waxy oil and said solvent thereby cooling said solvent-waxy oil mixture as it progresses from stage to stage through said chilling zone and thereby precipitating at least a portion of said wax from said oil under conditions of said high degree of agitation, separating the precipitated wax from a solvent-oil mixture and recovering a petroleum oil stock of reduced wax content from said mixture, the improvement which comprises adjusting the rate of solvent addition to the solvent-containing stages so that the greatest temperature drop occurs in the first solvent-containing stage of the chilling zone in which wax precipitation occurs with the subsequent stage to stage temperature drops in the remaining stages into which cold dewaxing solvent is injected and in which wax precipitation occurs progressively decreasing as the waxy oil-solvent mixture progresses through said chilling zone.

2. The process of claim 1 wherein the chilling zone is divided into at least six agitated stages.

3. The process of claim 2 wherein the numerical ratio of the temperature of (a) the feed entering the chilling zone minus the temperature reached in the first solvent containing/wax precipitation stage divided by (b) the temperature reached in the next to last stage minus the temperature reached in the last stage into which cold dewaxing solvent is injected and in which wax precipitation occurs, ranges between 2 and 20.

4. The process of claim 2 wherein the numerical ratio of the temperature drop across the first 10% of the solvent-containing stages, in which wax precipitation occurs starting with the feed temperature, divided by the temperature drop across the last 10% of stages into which cold dewaxing solvent is injected and in which wax precipitation occurs ranges from between 2 and 20.

5. The process of claim 2 wherein the cold dewaxing solvent comprises aliphatic ketones having from 3–6 carbon atoms.

6. The process of claim 5 wherein the dewaxing solvent includes aromatic solvents selected from the group consisting of benzene, toluene and xylene.

7. The process of claim 2 wherein said dewaxing solvent comprises $C_2$–$C_4$ chlorinated hydrocarbons.

* * * * *